United States Patent [19]

Freund

[11] 4,182,475

[45] Jan. 8, 1980

[54] DRUM CLOSURE ASSEMBLY

[75] Inventor: Donald F. Freund, Macon, Ga.

[73] Assignee: The Mead Corporation, Dayton, Ohio

[21] Appl. No.: 4,826

[22] Filed: Jan. 19, 1979

[51] Int. Cl.[2] ..... B65D 41/16; B65D 5/02

[52] U.S. Cl. ..... 229/5.7; 220/306; 220/307; 215/256

[58] Field of Search ..... 229/5.7, 5.8, 5.5; 220/73, 307, 85 K, 90; 215/256

[56] References Cited

U.S. PATENT DOCUMENTS

| | | | |
|---|---|---|---|
| 801,382 | 10/1905 | Keyes | 229/5.8 |
| 1,160,611 | 11/1915 | Hudson | 220/307 X |
| 1,454,846 | 5/1923 | Coates | 229/5.8 |
| 1,456,424 | 5/1923 | Coates | 229/5.8 |
| 2,706,065 | 4/1955 | Stone | 220/307 |
| 3,039,371 | 6/1962 | Leibreich | 93/55.1 R |
| 3,297,193 | 1/1967 | Stevens, Jr. | 220/306 |
| 3,332,572 | 7/1967 | Green | 220/307 |
| 3,912,110 | 10/1975 | Hammes | 220/307 |
| 3,945,529 | 3/1976 | Haag | 220/307 |
| 4,008,820 | 2/1977 | Ruetz | 215/256 |
| 4,037,748 | 7/1977 | Stubbs, Jr. | 220/306 X |

FOREIGN PATENT DOCUMENTS

| | | | |
|---|---|---|---|
| 858334 | 12/1970 | Canada | 220/307 |

*Primary Examiner*—Davis T. Moorhead
*Attorney, Agent, or Firm*—Charles N. Shane, Jr.; Stephen H. Cagle; Wilson G. Palmer

[57] ABSTRACT

A drum closure assembly which includes a ring member and a cover member, the cover member being cooperatively sized for insertion into the ring member. The ring member comprises outer and inner ring portions which are angularly displaced from parallel to one another. The cover member includes a top cover member and an annular wall member designed to abut the inner ring portion of the ring member and to seal the assembly when in use.

11 Claims, 11 Drawing Figures

FIG-5
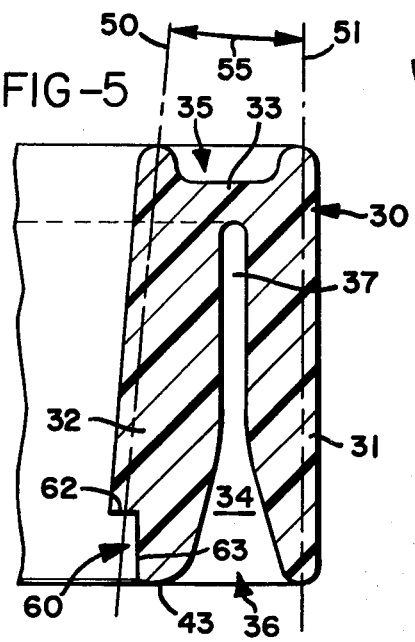
FIG-6
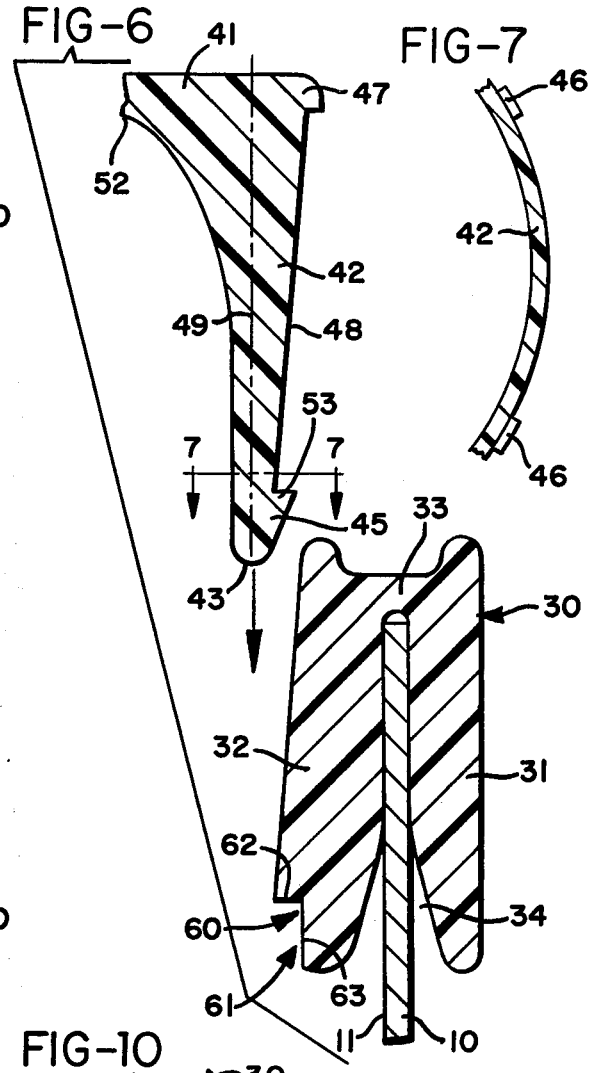
FIG-7
FIG-8
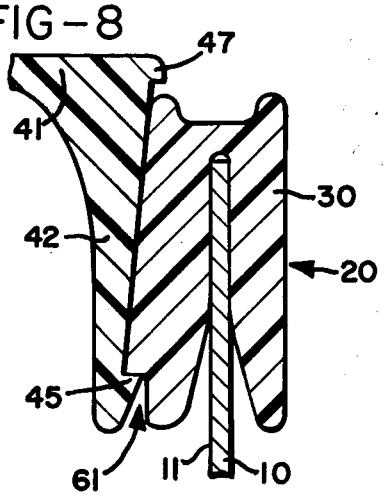
FIG-10
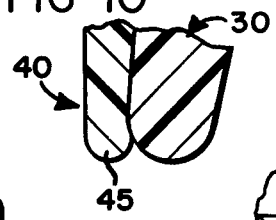
FIG-9
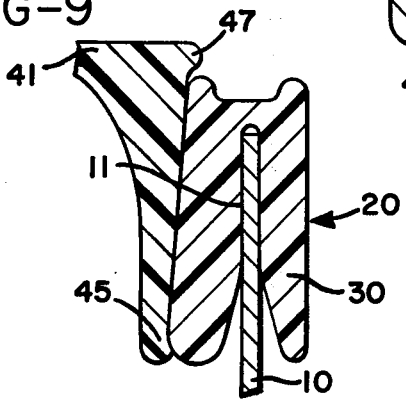
FIG-11
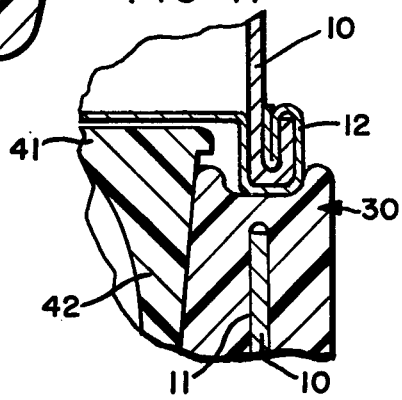

DRUM CLOSURE ASSEMBLY

BACKGROUND OF THE INVENTION

1. Subject Matter:

This invention relates to drum closure assemblies.

2. Prior Art:

This invention relates to a drum closure assembly and a method for securing the closure assembly to the open or top end of a drum body.

The drum which will be referred to in this application is a fibreboard drum of tubular form, which may be of laminated or nonlaminated structure. This type of fibreboard drum and the method for manufacturing same are disclosed in U.S. Pat. No. 3,039,371 to Leibreich. The primary advantage of fibreboard drums is that they can be manufactured in tubular form and then shipped or stored in flat form, thus presenting a substantial savings in terms of space usage. For the purpose of this application, these fibreboard drums are sometimes referred to as "KD Drums," the KD standing for "Knocked Down" which is simply descriptive of the condition in which the tubular fibreboard drums can be shipped and stored.

As can be appreciated, these drums are available in a variety of sizes, shapes, thicknesses and for a number of purposes. As explained above, the fibreboard drum may be of laminated or nonlaminated structure. If laminated, inner and outer plys are preferably of conventional kraft paper which may be either wet or dry finished. So, to, if the fibreboard is of nonlaminated construction, its opposite surfaces are wet or dry finished as may be required. In either construction, the surface of the fibreboard is preferably impervious to liquids, and the inner surface or in some instances both the inner and outer surfaces are lined with a protective coating of any conventional composition.

The drum containers are frequently used for packing such material as asphalt, rubber and the like which is poured in place in a liquid condition to be hardened upon cooling. For packaging such material, the interior surface of the drum is lined with any conventional coating material, i.e., silicone, polyethylene, polypropylene, that is commonly used for the purpose of rendering the drum impervious to absorption from the contents contained within the drum or moisture from outside ambient conditions. The tubular form is made from a fibreboard blank with its side edges overlapped and joined to any desired extent for forming the lap joint extending lengthwise of the tubular form. Adhesives, staples or other fastening means can be used to join the side edges.

Recently, it has been shown that other materials such as food slurries and the like can be conveniently packaged in fibreboard drums for shipping and storage. Other uses to which the fibreboard drums can be placed are obvious to one of ordinary skill in the art. In particular, there are in reality no limitations on the materials which can be retained or shipped by the fibreboard drums of this invention. In many instances, specific uses require modifications of the innermost protective or barrier coating of the fibreboard meet relevant Food and Drug Administration guidelines or the like, but in no instances are the technical problems with the formulation and use of such coatings serious. Therefore, for purposes of this application, it will be assumed the fibre drum closure assembly can be used with any such material and the specific use of the drum or the particular material to be contained by the drum are not alleged to be inventive features herein.

Logically, it has been found that the effective commercial use of the fibre drum disclosed hereinabove requires both a bottom closure member and a top closure member. It has been known to use a metal disk as the bottom for drum members. The use of such bottom members and an apparatus for producing a container having a tubular fibreboard body portion and a metal disk bottom member is described by U.S. Pat. No. 3,057,265 issued to Leibreich in 1962. In this patent it is described how drums can be formed and a metal bottom seamed onto the bottommost edge of the tubular container member. In this fashion a fibreboard drum is formed having a sealed bottom member but having no top.

There have been a variety of previous attempts in the use and manufacture of a top closure member for use with fibreboard drums. The previous attempts to produce such drums consistently suffer from disadvantages. Among these are that the top member did not provide a good seal and, therefore, could not be used for materials which could leak or which could be spoiled or otherwise disadvantages by exposure to the atmosphere. Secondly, many of the prior art attempts to form a top closure member did not have stacking capabilities which provide a substantial advantage in the shipping and storage of the fibreboard drums once they have been filled. Third, many of these prior art top closure members required actual assembly on a machine such as a seaming machine. This is, of course, extremely cumbersome, expensive and not time efficient. Finally the prior closure members either did not hold the fibreboard drum round for purposes of filling. As can be appreciated, it is necessary for the fibreboard drum to be held in a substantially round configuration during filling so that the maximum amount of material can be inserted into each drum. The drum closure assembly of this invention solves all of these and other problems which have been appreciated by the prior art.

Other patents of which the applicant is aware which deal with the concept of closing drums include:

U.S. Pat. No. 801,382 to Keyes (1905)
U.S. Pat. No. 1,528,489 to Snell (1926)
U.S. Pat. No. 1,725,525 to Kondolf (1929)
U.S. Pat. No. 3,054,548 to Scott (1962)
U.S. Pat. No. 3,297,193 to Stevens (1967)
U.S. Pat. No. 3,843,013 to Brooks (1974)

BRIEF DESCRIPTION OF THE DRAWINGS

FIG. 5 is a cross-sectional view of the ring member of this invention showing one locking means embodiment.

FIG. 6 is a cross-sectional view of the cover member and ring member of this invention prior to insertion.

FIG. 7 is a top view of a portion of the annular wall extending from the cover member of this invention.

FIG. 8 is a cross section of the drum closure assembly in locked position.

FIG. 9 is a cross section of the drum closure assembly in locked position showing an alternative locking embodiment.

FIG. 10 is an exaggerated view of one locking means as shown in FIG. 9.

FIG. 11 is a cross-sectional view of stacked fibre drums using the drum closure assembly of this invention.

SUMMARY OF THE INVENTION

Figure 1:
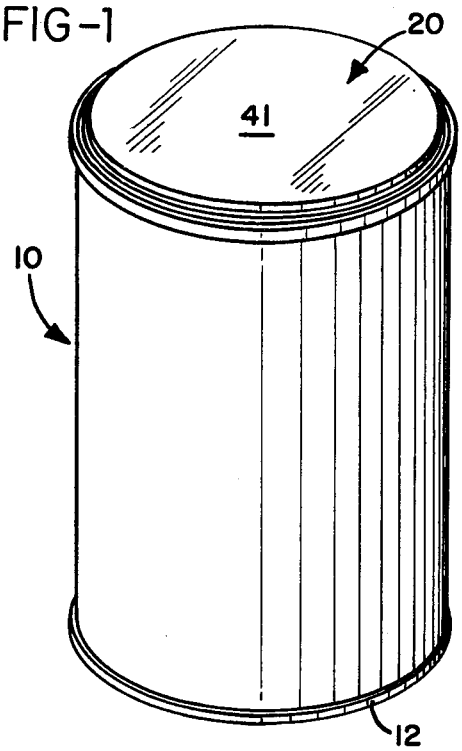
FIG. 1 is a perspective view showing the fibre drum of this invention with the drum closure assembly locked in place.

This invention relates to a drum closure assembly which comprises a ring member and a cover member. The ring member includes an outer ring portion and an inner ring portion which is laterally displaced from parallel to the outer ring portion. A connecting portion fixedly joins the inner and outer ring portions and an elongated groove is defined in said ring member, the groove being receptive to the uppermost edge of a drum. The cover member is cooperatively sized for insertion into the ring member and includes a top cover member and an annular wall member. The annular wall member is continuous and projects downwardly from the top cover member. The circumference of the bottommost edge of the annular wall member is smaller than the circumference of the top cover member and at the same time the annular wall member is angularly displaced from a line perpendicular to a plane defined by the top cover member.

DESCRIPTION OF THE PREFERRED EMBODIMENTS

For the purposes of promoting an understanding of the principles of this invention, reference will now be made to the embodiment illustrated in the drawings and specific language will be used to describe the same. It will nevertheless be understood that no limitation of the scope of the invention is thereby intended, such alterations and further modifications in the illustrated device, and such further application of the principles of the invention as illustrated therein contemplated as would normally occur to one skilled in the art to which the invention relates.

The fibreboard drum 10 is made from wet strength Kraft and has a wall thickness of 0.01 inches to 0.09 inches. Preferably the wall thickness, including all laminate layers, is from about 0.015 inches to about 0.075 inches. A most preferred range for wall thickness is from about 0.019 inches to about 0.045 inches. For commercial purposes it has been found that the diameter of the fibreboard drum should be from about 5 inches to about 24 inches and the height of the drum up to about 72 inches. Dimensions substantially larger and smaller than these can be very conveniently used depending upon the product to be packaged and on available apparatus for assembling and seaming bottoms onto such drums.

The fibreboard drums 10 are in general tailored for a specific purpose and are most preferably used for carrying materials that are poured in hot, liquid form and then solidified, such as asphalt, adhesives, resins, and waxes. The interior 11 of the fibre drums 10 can be specially coated to meet the release and/or protective requirements of any product it carries. Coatings can be used to insure grease-proofness, moisture and water proofness amother other characteristics. Coatings can be eliminated if plastic inner bags are to be used in the fibre drum. For tacky products such as asphalt, resin, adhesives, etc., coatings can be used to give positive release from the drum wall, even when the drum is filled at high temperatures. As has been stated hereinabove, the specific size or coated features of the drum 10 of this invention is not alleged to be an inventive feature herein. Rather, it is merely stated that the drum 10, metal bottom 12 and drum closure assembly 20 must be cooperatively sized to form an effective container. It should also be noted that the drum closure assembly 20 can be used equally effectively for both top and bottom in certain instances. It should be understood that the references herein to a metal bottom being seamed to the fibre drum refers to the preferred application and is not intended as a limitation on the scope of application of drum closure assemblies.

A first element in the drum closure assembly 20 is ring member 30. In describing ring member 30 attention is drawn specifically to FIGS. 1 and 5 of the drawings. Ring member 30 consists of an outer ring portion 31, an inner ring portion 32 and a connection portion 33. In the most preferred embodiment of this invention, ring member 30 is made from a moldable, resiliently flexible material such as polyethylene or other plastic material, and portions 31, 32 and 33 form a continuous structure.

The positioning of outer ring portion 31, inner ring portion 32 and connecting portion 33 define an elongated groove 34. Elongated groove 34 is continuous throughout the circumference of ring member 30 and is preferably funnel shaped at the open end of groove 34 to provide means for guiding drum 10 into groove 34. Specifically, it is noted that the mouth 36 of groove 34 is substantially wider than the innermost recessed portion 37 of groove 34.

It is important to note that in the preferred embodiment of this invention inner ring portion 32 is angularly displaced from outer ring portion 31. Referring now to FIG. 5, it is seen that line 50 through inner ring portion 32 is angularly displaced from parallel with line 51 through outer ring portion 31 by angle 55. The angular displacement 55 of portions 31 and 32 is from about 2 to about 25 degrees. In the alternative angle 55 is described as the angle formed by the centerline of drum wall 10 and tapered inside annular surface of ring portion 32. In addition, inner ring portion 32 has means for cooperative action with locking means 45 found on annular wall member 42. These means are generally designated by the number 60 and are discussed more fully hereinafter. A tight fit between groove 34 and drum 10 results from portions 37 of groove 34 being narrower than the thickness of drum 10. This provides an interference fit between the two members.

In the most preferred embodiment of this invention, connecting portion 33 of ring member 30 also contains nesting means 35. Nesting means 35 in most instances is a groove which is receptive to the seamed metal bottom of a stacked drum 10. See especially FIG. 11 showing stacked drums 10 in a nesting configuration. Other nesting configurations for connecting portion 33 are readily within the ambit of this application. The grooved nesting means are shown here merely for purposes of clarification.

The second primary element of drum closure assembly 20 is the cover member 40. In the preferred embodiment of this invention, cover member 40 consists of a top cover member 41 and an annular wall member 42.

Although members 41 and 42 are treated separately, in the most preferred embodiment of this invention, both members would be molded into a continuous cover member 40 using resiliently flexible material identical to that used in making ring member 30.

Figure 2:
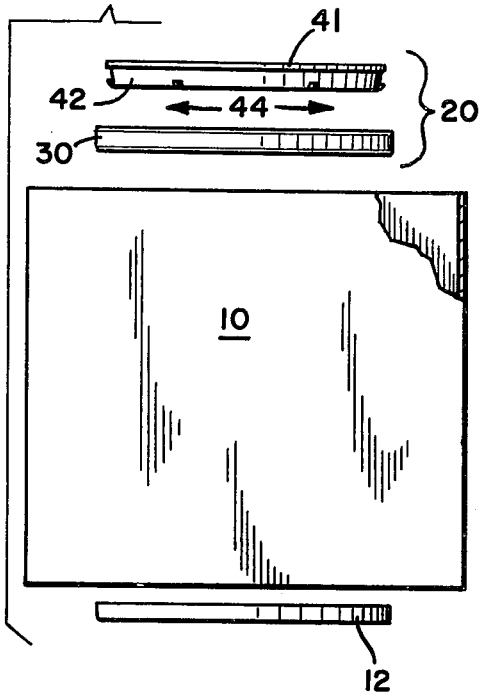
FIG. 2 is an exploded view showing the elements of the fibre drum, (partially in section) metal bottom and drum closure assembly elements of this invention.
Figure 3:
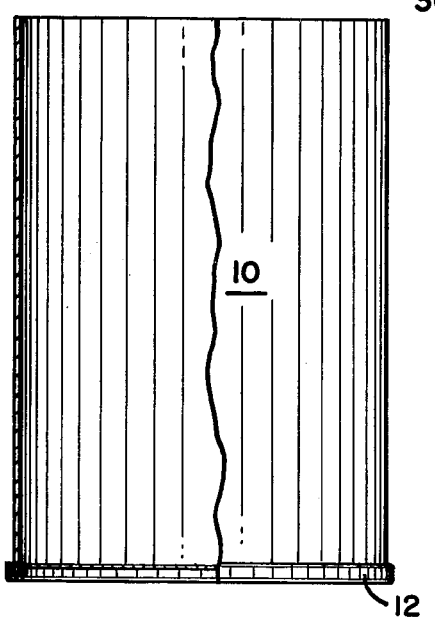
FIG. 3 is a front elevation of a fibre drum of this invention with seamed metal bottom in place. Portions of this figure have been cut away to show the relationship between the fibreboard drum and the seamed metal bottom.
Figure 4:
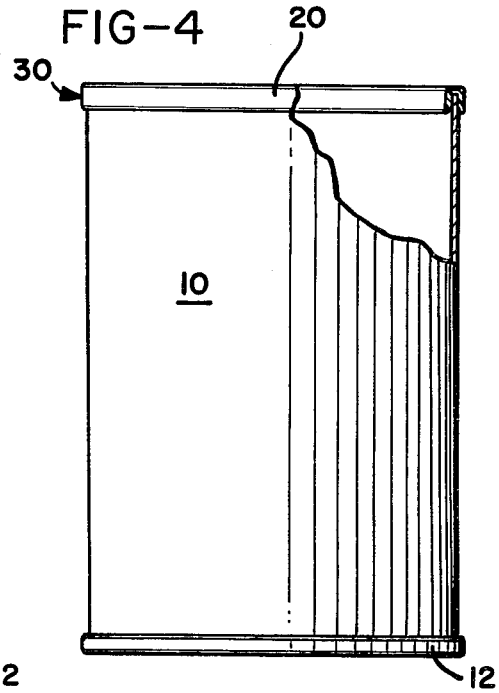
FIG. 4 is a front elevation identical to FIG. 3 except the drum closure assembly is shown locked in place with portions thereof partially cut away.

Referring now more particularly to FIGS. 2 and 7, the cover member 40 will be described. The top cover member 41 comprises a substantially circular inner portion for the drum closure 20 and is continuous and in reality forms the true top to retain the contents of drum 10 during storage and shipping.

Annular wall member 42 projects from the inner surface 52 of top cover member 41. As is shown more particularly in FIG. 6 the outer surface 48 of annular wall member 42 is angularly displaced from a line perpendicular to a plane defined by said top cover member 41. In particular, such a perpendicular line is illustrated by the member 49 in FIG. 6.

The angle between outer surface 48 and perpendicular line 49 is from about 2 degrees to about 25 degrees. It is noted that this is substantially similar to the displacement angle 55 between outer ring portion 31 and inner ring portion 32. By design, if these two angular displacements are substantially equal, then annular wall member 42 and inner ring portion 32 are able to functionally interlock to provide an effective seal as is shown more particularly by FIGS. 8 and 9.

Found at the anterior end of annular wall member 42 are locking means 45. Locking means 45 can take a variety of configurations including a slightly curled portion as is shown in FIGS. 9 and 10 or can take the form of a continuous locking surface 53 as is shown in FIG. 6. In the most preferred embodiment of this invention, the locking means 45 take the form of locking tabs 46 projecting from the outer surface 48 of annular wall member 42. The number of locking tabs is not critical although preferably from about 6 to about 10 locking tabs 46 spaced evenly throughout the circumference of annular wall member 42.

As is shown more particularly by FIGS. 5 inner ring portion 32 has cooperative locking means 60. These cooperative locking means 60 take any form which is functionally effective to work in cooperation with the locking means 45 to hold cover member 40 fixedly within ring member 30. In the case of locking tab 46, the cooperative locking means 60 would take the form of a locking groove 61 having walls 62 and 63. In this fashion and as is shown by FIG. 8, the locking tab 46 fixedly engages wall 62 of locking groove 61 to lock said cover member into said ring member. In an alternative embodiment shown by FIGS. 9 and 10, the locking means 45 is simply an expanded portion of annular wall member 42 which acts in cooperation with inner ring portion 32 to provide a friction lock of cover member 40 and ring member 30.

As can be appreciated from the above description of ring member 30 and cover member 40 in the most preferred embodiment of this invention, both members are constructed using a resiliently flexible plastic material. Any of the currently available polymeric materials are suitable for these purposes with the final definition of best materials being dependent on the end use to which the drum closure assembly is to be placed and ultimately on the material to be contained by drum 10. It is important that the ring member 30 and cover member 40 be slightly flexible to permit use of locking means 45. In this fashion, a tight lock can be achieved as is illustrated by the drawings and the cap can be removed with special tools adapted at breaking such lock.

In other embodiments where a tight seal is not desired, it is convenient to use the pressure locking means as are shown in FIGS. 9 and 10 whereby substantially less pressure is required to remove cover member 40 from ring member 30. The particular configuration of locking means is ultimately dependent on the tightness of the seal desired and, therefore, on the material to be contained by drum 10. Configurations and locking means other than those shown in the drawings and described hereinabove are readily suitable to the drum closure assembly of this invention.

In addition to annular wall member 42, cover member 40 optionally contains a protective lip 47 as is illustrated more completely in FIGS. 6, 8 and 9. Protective lip 47 can serve a variety of functions, one of which would be to prevent penetration of the seal between cover member 40 and ring member 30 by moisture and the like. An alternative, but by no means limiting function is to serve as a fulcrum point for tools designed for removing cover member 40.

Although the foregoing has described the use of a drum closure assembly which is designed to be opened, it is also possible that such an assembly could be permanently sealed. The permanent seal could be effected by a machining of cover member 40 and ring member 30 to tight dimensioned standards or by the use of an adhesive to join cover member 40 and ring member 30. These and other options remain equally viable in the use of the drum closure assembly 20 of this invention and ultimately depend on the final product and conditions of storage and shipping.

It is important to note here that the circumference of the bottommost edge of annular wall member 42 designated herein as 44 is smaller than the circumference top cover member 41. This permits convenient insertion of cover member 40 into ring member 30. The insertion of cover member 40 into ring member 30 places a seal between annular wall member 42 and inner ring portion 32, the seal resulting from the interference fit between groove 34 and drum 10. Thus the insertion of cover member 40 not only seals the drum closure assembly but also secures the drum closure assembly to the drum 10. It is important to note here that both of these sealing features can be conveniently accomplished without the use of adhesives. In practice the seal between cover member 40 and ring member 30 is potentially sanitary which makes this available as a food packaging material.

Other advantages enjoyed by the drum closure assembly 20 of this invention include the fact that the drum closure assembly can be utilized and assembled separate from seaming machines normally necessary in the use of fibre drums with metal bottoms.

In practice the drum forming assembly of this invention would be used by first assembling in a drum 10 and seaming a metal bottom 12 onto said drum. At this time, the ring member 30 would be inserted onto the drum 10 by inserting the uppermost and unsealed edge of drum 10 into elongated groove 34. At that time, cover member 40 would be inserted into ring member 30 and until locking means 45 actively engage cooperative locking means 60. At this time, the entire assembly is sealed and the drum closure assembly 20 is fixedly attach d to the drum 10 by pressure between inner ring portion 32 and outer ring portion 31.

While the invention has been illustrated and described in detail in the drawings and the foregoing description, the same is to be considered as illustrative and not restrictive in character, it being understood that only the preferred embodiment has been shown and described and that all changes and modifications that come within the spirit of the invention are desired to be protected.

What is claimed:

1. A drum closure assembly comprising:

(A) a ring member, said ring member including:

(i) an outer ring portion;

(ii) an inner ring portion laterally displaced from said outer ring portion, said inner ring portion being angularly displaced from parallel to said outer ring portion;

(iii) a connecting portion fixedly joining said inner ring portion to said outer ring portion;

(iv) an elongated groove being defined by said inner ring portion, said outer ring portion and said connecting portion, said groove being receptive to the uppermost edge of a drum, and (B) a cover member, said cover member being cooperatively sized for insertion into said ring member, said cover member including:

(i) a top cover member;

(ii) a continuous annular wall member projecting downwardly from said top cover member, the circumference of the bottommost edge of said annular wall member being smaller than the circumference of said top cover member, the outer surface of said annular wall member being angularly displaced from a line perpendicular to a plane defined by said top cover member.

2. The drum closure assembly of claim 1 wherein said annular wall member is continuous and wherein from about 2 to about 10 locking tabs extend peripherally from said annular wall member, said locking tabs being fixedly engageable by the bottommost edge of said inner ring portion wherein said cover member is inserted into said ring member.

3. The drum closure assembly of claim 1 wherein a protective lip extends peripherally from said top cover member.

4. The drum closure assembly of claim 1 wherein said ring member and said cover member are formed from a resiliently, flexible plastic material.

5. The drum closure assembly of claim 1 wherein said ring member further includes nesting means.

6. The drum closure assembly of claim 5 wherein said nesting means comprises a groove in the uppermost surface of said connecting portion, said groove being receptive to cooperating nesting means found at the bottom of an assembled drum.

7. The drum closure assembly of claim 1 wherein said annular wall and said inner ring member are equally angularly displaced from said line perpendicular to a plane defined by said top cover member and said outer ring portion, respectively.

8. The drum closure assembly of claim 7 wherein said angular displacement is from about 2 degrees to about 25 degrees.

9. A drum closure assembly comprising:

(A) a ring member made from resiliently, flexible plastic material, said ring member including:

(i) an outer ring portion;

(ii) an inner ring portion laterally displaced from said inner ring, said inner ring portion being from about 5 degrees to about 25 degrees angularly displaced from parallel to said outer ring portion;

(iii) a connecting portion fixedly joining said inner ring portion to said outer ring portion;

(iv) an elongated groove being defined by said inner ring portion, said outer ring portion and said convecting portion, said groove being receptive to the uppermost edge of a drum, and (v) nesting means located in the uppermost surface of said connecting portion; and (B) a cover member, said cover member being cooperatively sized for lockable insertion into said ring member, said cover member including:

(i) a top cover member having an annular protective lip extending therefrom, (ii) an annular wall member projecting downwardly from said top cover member, the circumference of the bottommost edge of said annular wall member being smaller than the circumference of said top cover member, the outer surface of said annular wall member being from about 2 degrees to about 25 degrees angularly displaced from a line perpendicular to a plane defined by said top cover member, and (iii) from about 2 to about 10 locking tabs extending peripherally from said annular wall member, said locking tabs being fixedly engageable by the bottommost edge of said inner ring portion when said cover member is inserted into said ring member.

10. The drum closure assembly of claim 9 wherein said nesting means comprises a groove in the uppermost surface of said connecting portion, said groove being receptive to cooperating nesting means found at the bottom of an assembled drum.

11. The drum closure assembly of claim 9 wherein said annular wall and said inner ring member are equally angularly displaced from said line perpendicular to a plane defined by said top cover member and said outer ring portion, respectively.

* * * * *